United States Patent [19]

Aoki et al.

[11] 4,445,481

[45] May 1, 1984

[54] METHOD FOR CONTROLLING THE AIR-FUEL RATIO OF AN INTERNAL COMBUSTION ENGINE

[75] Inventors: Keiji Aoki; Toshiyuki Takimoto, both of Susono, Japan

[73] Assignee: Toyota Jidosha Kogyo Kabushiki Kaisha, Toyota, Japan

[21] Appl. No.: 333,568

[22] Filed: Dec. 22, 1981

[30] Foreign Application Priority Data

Dec. 23, 1980 [JP] Japan ..... 55-181210

[51] Int. Cl.[3] ..... F02M 17/00

[52] U.S. Cl. ..... 123/440; 123/489

[58] Field of Search ..... 123/440, 489

[56] References Cited

U.S. PATENT DOCUMENTS

| | | | |
|---|---|---|---|
| 4,169,440 | 10/1979 | Taplin et al. | 123/492 X |
| 4,240,390 | 12/1980 | Takeda | 123/480 |
| 4,306,529 | 12/1981 | Chiesa et al. | 123/489 X |
| 4,377,143 | 3/1983 | Hamburg | 123/436 X |

*Primary Examiner*—Tony M. Argenbright

*Attorney, Agent, or Firm*—Cushman, Carby & Cushman

[57] ABSTRACT

Engine parameter signals indicative of the operating condition of the engine and an air-fuel ratio signal indicative of whether the air-fuel ratio condition of the engine is on the rich side or the lean side relative to a stoichiometric condition are produced. When the engine operates under a predetermined state, the fuel feeding rate to the engine is controlled in response to the engine parameter signals and the air-fuel ratio signal, by a closed loop control operation, in order to determine a learning control correction factor $F_G$. In the closed loop control operation, a feedback correction factor $F_B$ is calculated depending upon the air-fuel ratio signal, and the fuel feeding rate is corrected depending upon the calculated factor $F_B$, so as to control the air-fuel ratio condition to a condition close to the stoichiometric condition. At the same time, the learning control correction factor $F_G$ is adjusted, so as to settle the feedback correction factor $F_B$ within a predetermined range while at the same time maintaining the air-fuel ratio condition close to the stoichiometric condition. After the closed loop control operation is completed, the fuel feeding rate is controlled, by open loop in response to the engine parameter signals and the adjusted learning control correction factor $F_G$, so as to control the air-fuel ratio condition at a desired condition which is different from the stoichiometric condition.

7 Claims, 8 Drawing Figures

| |
|---|
| Fig. 4A |
| Fig. 4B |

4
50
IS FULLY WARMED-UP ?
NO
3
YES
53
IS LEARNING COMPLETION FLAG ON ?
YES
NO
70
IS $F_B \leq 1.0$ ?
NO
YES
72
$F_B \leftarrow 1.0$
71
$F_B \leftarrow F_B - K_i$
3
57
IS A/F RICH ?
NO
YES
58
$F_B \leftarrow F_B - K_i$
59
$F_B \leftarrow F_B + K_i$
60
IS THERE INVERSION ?
NO
YES
61
IS RICH → LEAN ?
NO
YES
63
$F_{BC} \leftarrow \frac{F_{BMAX} + F_B}{2}$
62
$F_{BMAX} \leftarrow F_B$
2
3

METHOD FOR CONTROLLING THE AIR-FUEL RATIO OF AN INTERNAL COMBUSTION ENGINE

BACKGROUND OF THE INVENTION

The present invention relates to an air-fuel ratio control method for controlling, by adjusting the fuel feeding rate, the air-fuel ratio condition of an internal combustion engine at a desired condition which is different from a stoichiometric condition.

There is known an internal combustion engine which controls its air-fuel ratio condition at a desired condition on the lean side with respect to a stoichiometric condition, by intermittently injecting fuel from at least one electric fuel injection valve. In such an engine, the closed loop air-fuel ratio control for controlling the air-fuel ratio condition depending upon a signal from the exhaust gas sensor, which detects the concentration of a certain component, such as the oxygen component, contained in the exhaust gas, cannot be executed. This is because the existing exhaust gas sensor (hereinafter called an $O_2$ sensor) only discriminates whether the air-fuel ratio condition surrounding the sensor is on the rich side or on lean side with respect to the stoichiometric condition. In other words, the existing $O_2$ sensor cannot discriminate whether or not the condition surrounding the sensor becomes a desired condition, which is on lean side with respect to the stoichiometric condition.

Therefore, a lean burn engine, in which the air-fuel ratio condition is controlled at a lean condition, has to control the air-fuel ratio condition by an open loop control operation without using the $O_2$ sensor. Namely, in the lean burn engine, the fuel feeding rate is adjusted, depending upon its intake air flow rate or its intake manifold vacuum pressure and upon its rotational speed. No signal from the $O_2$ sensor is used. According to such an open loop control, it is difficult to automatically compensate not only the amount of scatter, or error, measured by the sensors for detecting the engine parameters, for example, the air-flow sensor, the manifold vacuum pressure sensor, the rotational speed sensor and the like, but also the amount of scatter in the controlled fuel rate by the fuel injection valve, of each engine. As a result, the controlled air-fuel ratio condition of each engine, although each one has the same type sensors and injection valve, becomes different from each other. Particularly, in the lean burn engine, the scatter in the controlled air-fuel ratio condition causes the characteristics of the emitted amount of HC, CO and $NO_x$ from the engine fuel consumption, and engine torque to extremely deteriorate.

SUMMARY OF THE INVENTION

It is, therefore, an object of the present invention to provide an air-fuel ratio control method for an internal combustion engine, whereby the air-fuel ratio condition can be automatically and correctly controlled to a desired condition which is determined to be on the lean side of a stoichiometric condition, even when there are scatters or errors measured by sensors and/or scatters or errors controlled by control elements, which sensors and elements are used for controlling the air-fuel ratio condition.

According to the present invention, a method for controlling the air-fuel ratio in an internal combustion engine which has a sensor means for detecting whether the air-fuel ratio condition is on the rich side or on the lean side with respect to the stoichiometric condition and for producing an air-fuel ratio signal which indicates the detected result, comprises the steps of: detecting the operating condition of the engine for producing the engine parameter signals which indicates the detected operating condition; controlling, in response to the engine parameter signals and to the air-fuel ratio signal, by a closed loop control operation, the fuel feeding rate to the engine only when the engine is operated under a predetermined operating condition, the closed loop control step including the steps of calculating a feedback correction factor related to the fuel feeding rate depending upon the air-fuel ratio signal; correcting the fuel feeding rate to the engine in accordance with the calculated feedback correction factor, so that the air-fuel ratio condition of the engine is close to the stoichiometric condition; and adjusting a learning control correction factor, so that the feedback correction factor is within a predetermined range, while at the same time maintaining the air-fuel ratio condition of the engine close to the stoichiometric condition; and controlling, in response to the engine parameter signals and to the adjusted learning control correction factor, by the open loop control operation, the fuel feeding rate of the engine, so as to maintain the air-fuel ratio of the engine at a desired condition which is different from the stoichiometric condition, after the closed loop control operation is completed.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
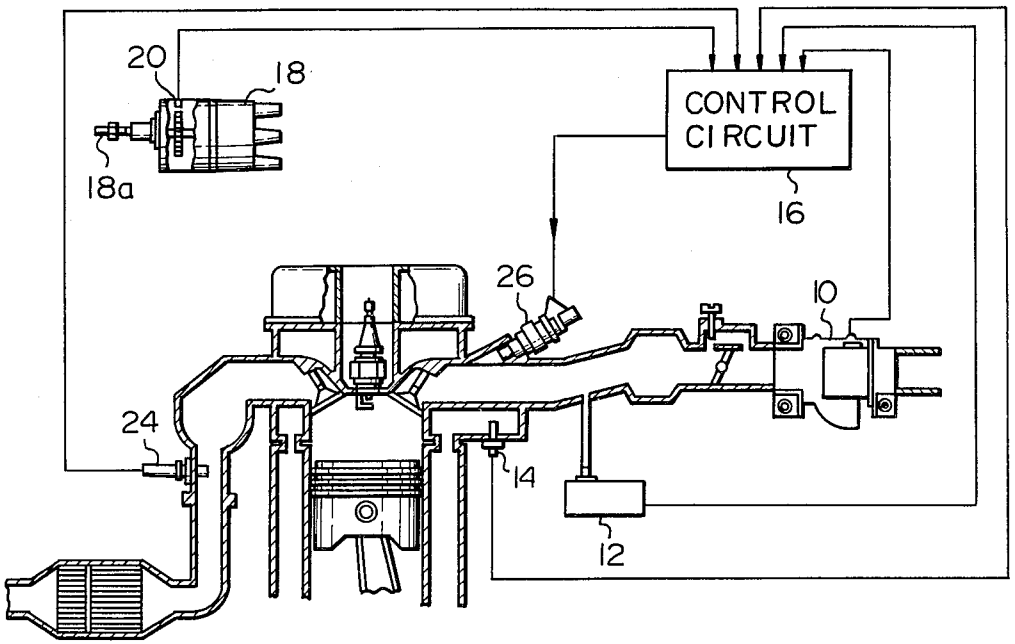
FIG. 1 is a schematic diagram illustrating an electronic fuel injection control system of an internal combustion engine, on which a method of the present invention is used.

Referring to FIG. 1, reference numeral 10 denotes an air flow sensor which detects the flow rate of the air sucked into an internal combustion engine and generates a voltage that corresponds to (in general, inversely proportional to) a detected flow rate. A pneumatic pressure sensor 12 detects the absolute pneumatic pressure in the intake manifold and generates a voltage that corresponds to a detected pressure. A coolant temperature sensor 14 detects the temperature of the coolant and generates a voltage which corresponds to the detected temperature. The output voltages from the air flow sensor 10, pneumatic pressure sensor 12 and coolant temperature sensor 14 are fed to a control circuit 16.

A distributor 18 of the engine is equipped with a crank angle sensor 20 which generates an angular position signal every time the distributor shaft 18*a* rotates by a predetermined angle, for example, 30° in terms of the crank angle. The angular position signal from the crank angle sensor 20 is fed to the control circuit 16.

The exhaust passage of the engine, is equipped with an $O_2$ sensor 24. The $O_2$ sensor 24 produces an output responsive to the oxygen concentration in the exhaust gas, i.e., produces different voltages depending upon whether the air-fuel ratio condition of the engine is on the rich side or on the lean side relative to the stoichiometric condition. The output voltage from the $O_2$ sensor 24 is fed to the control circuit 16.

A single electric fuel injection valve 26, or a plurality of electric fuel injection valves 26, receives an injection signal fed from the control circuit 16, and thus injects the compressed fuel supplied from a fuel supply system (not shown) into the intake port portion.

Figure 2:
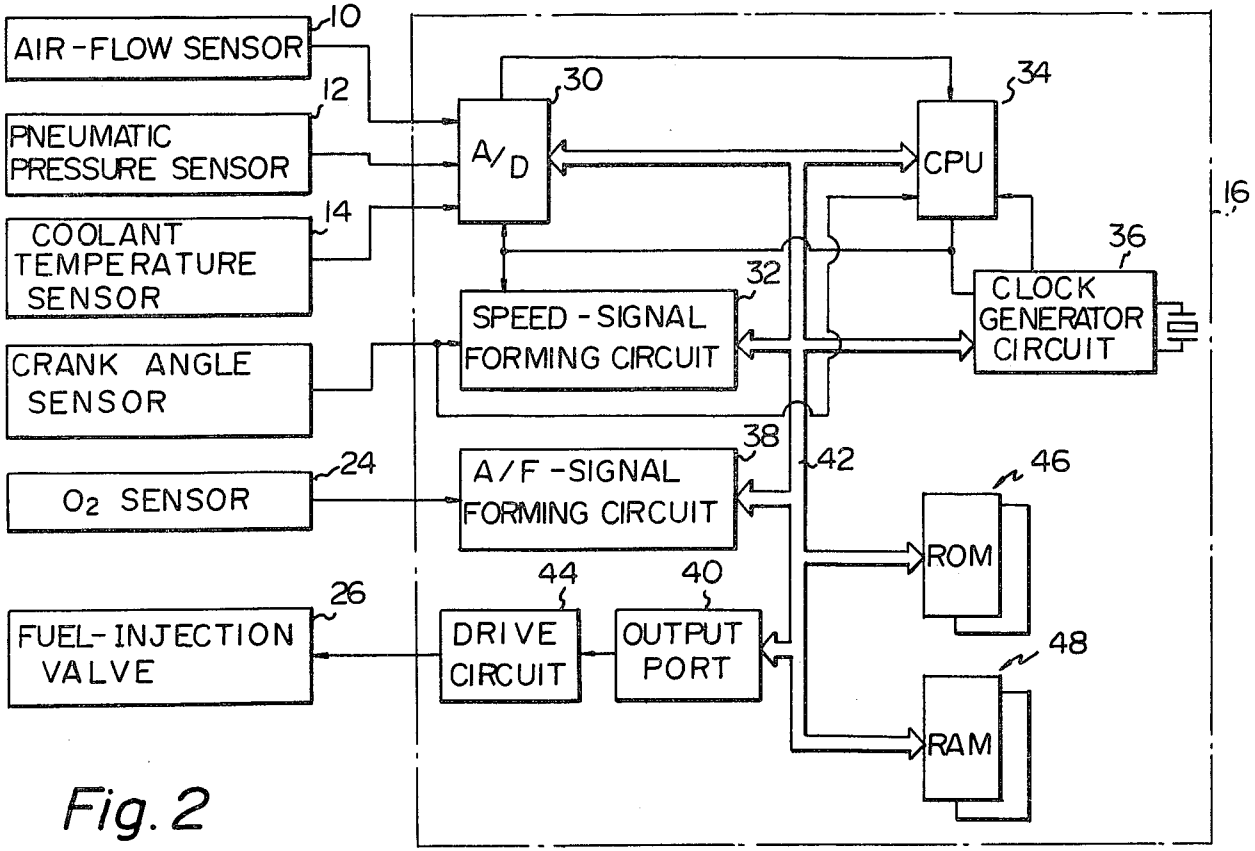
FIG. 2 is a block diagram illustrating the control circuit shown in FIG. 1.

FIG. 2 illustrates an example of the control circuit 16 of FIG. 1.

The output voltages from the air flow sensor 10, the pneumatic pressure sensor 12 and the coolant temperature sensor 14 are applied to an analog to digital (A/D) converter 30, having the functions of an analog multiplexer and a converter, and are converted into binary signals in sequence at predetermined conversion intervals.

The angular position signal produced by the crank angle sensor 20 at every crank angle of 30° is fed to a speed-signal forming circuit 32, and, furthermore, to a central processing unit (CPU)34 as an interrupt request signal. As is widely known, the speed-signal forming circuit 32 has a gate that opens and closes in response to the angular position signal and a counter which counts the number of clock pulses that pass through the gate each time the gate is opened. Thus, the speed-signal forming circuit 32 forms a binary speed signal having a value which corresponds to the rotational speed of the engine.

The output voltage from the $O_2$ sensor 24 is applied to an air-fuel ratio (A/F) signal forming circuit 38. The A/F signal forming circuit 38 has a comparator which compares the output voltage from the $O_2$ sensor 24 with a reference voltage, and a latch circuit which temporarily stores the output from the comparator. A binary A/F signal having a logic level of "1" or "0", which indicates whether the air-fuel ratio condition of the engine is on the rich side or on the lean side relative to the stoichiometric condition, is produced from this A/F signal forming circuit 38.

An injection signal having a pulse-width $T_{EFI}$ is fed to a predetermined bit position of an output port 40 from the CPU 34 via a bus 42. Then, the injection signal is sent to the fuel injection valve 26 via a drive circuit 44. Accordingly, the fuel injection valve 26 is energized for a time corresponding to the pulse-width $T_{EFI}$, and the fuel, in an amount corresponding to the injection pulse-width $T_{EFI}$, is supplied to the engine.

The A/D converter 30, the speed-signal forming circuit 32, the A/F signal forming circuit 38 and the output port 40 are connected via the bus 42 to the CPU 34, the read-only memory (ROM)46, the random access memory (RAM)48 and the clock generator circuit 36, which constitute the microcomputer. The input/output data are transferred through the bus 42.

Although not shown in FIG. 2, the microcomputer is further equipped with an input/output control circuit and a memory control circuit, in the customary manner.

A program for executing the main processing routine, that will be mentioned later, and a variety of data, table and constants necessary for executing the processing, have been stored beforehand in the ROM 46.

In FIGS. 1 and 2, the engine is equipped with both the air flow sensor 10 and the pneumatic pressure sensor 12. The present invention, however, can be put into practice even if only one of these sensors 10 and 12 is provided.

Below is briefly mentioned the processing steps, in conjunction with FIG. 3, for controlling the fuel injection using the microcomputer. When the power-suppy circuit is turned on, the CPU 34 executes an initializing routine 43 to reset the content of the RAM 48 and to set the constants to initial values. The program then proceeds to a main routine 45 which repetitively executes the operation of the learning control and the calculation of the fuel feeding rate, that will be mentioned later. The CPU 34 further executes an interrupt routine 47, responsive to the crank angle interrupt signal produced at every crank angle of 30°, to form an injection signal and sends it to the output port 40, or executes an interrupt routine 49 responsive to a timer interrupt signal produced at each predetermined period to form the injection signal and sends it to the output port 40.

While the main processing routine is being executed, or while some other interrupt routine is being executed, the CPU 34 introduces the new data, that represents the rotational speed N of the engine, received from the speed-signal forming circuit 32, and stores it in a predetermined region in the RAM 48. Further, relying upon the A/D conversion interrupt routine, executed at each predetermined period of time or at each predetermined crank angular position, the CPU 34 introduces the new data that represents a value U, which is inversely proportional to the flow rate Q of the intake air, the new data that represents the pneumatic pressure P in the intake manifold, and the new data that represents the coolant temperature THW, and stores these new data in predetermined regions of the RAM 48.

Figure 3:
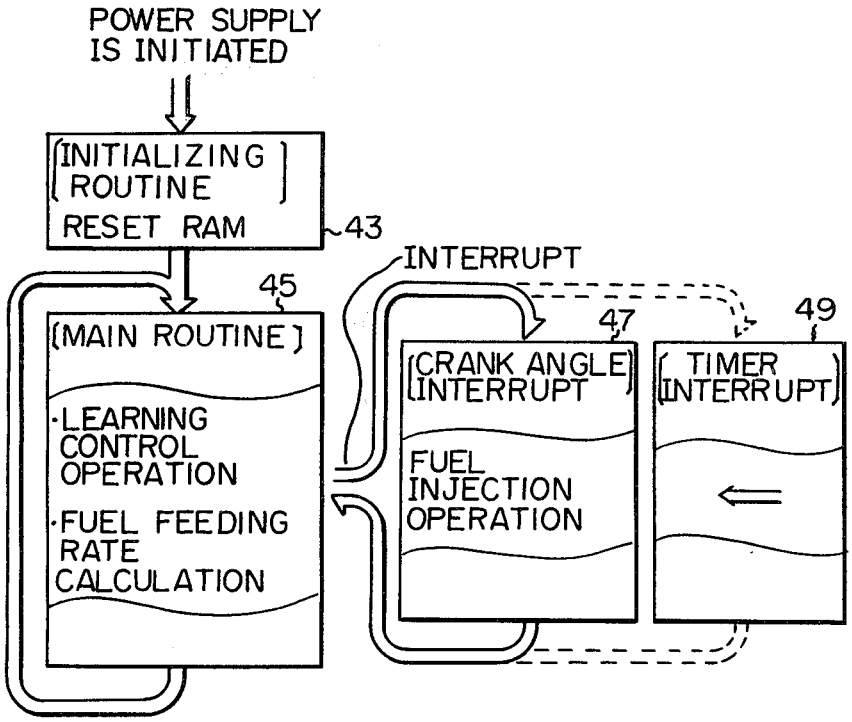
FIG. 3 is a schematic flow diagram illustrating the control programs of the microcomputer in the control circuit of FIG. 2.
Figures 4, 4A:
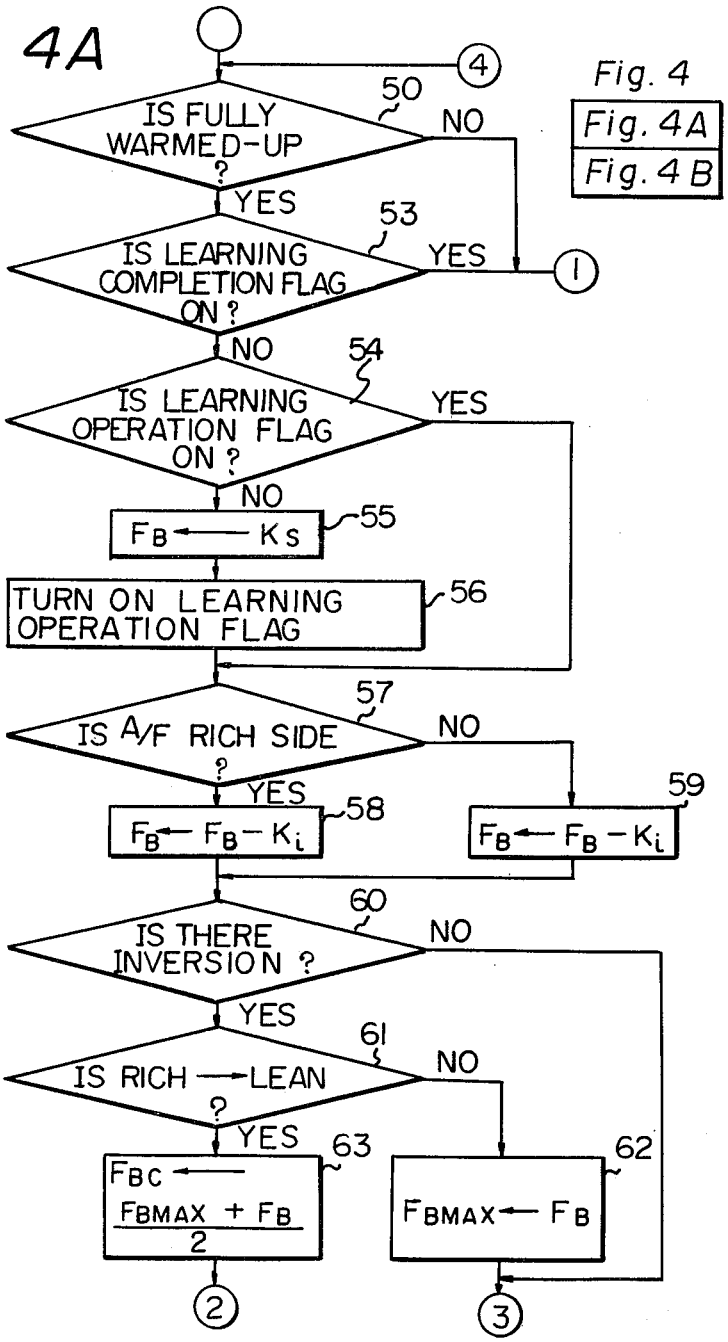
FIG. 4 is a flow diagram illustrating a part of one example of the control program shown in FIG. 3.
Figure 4B:
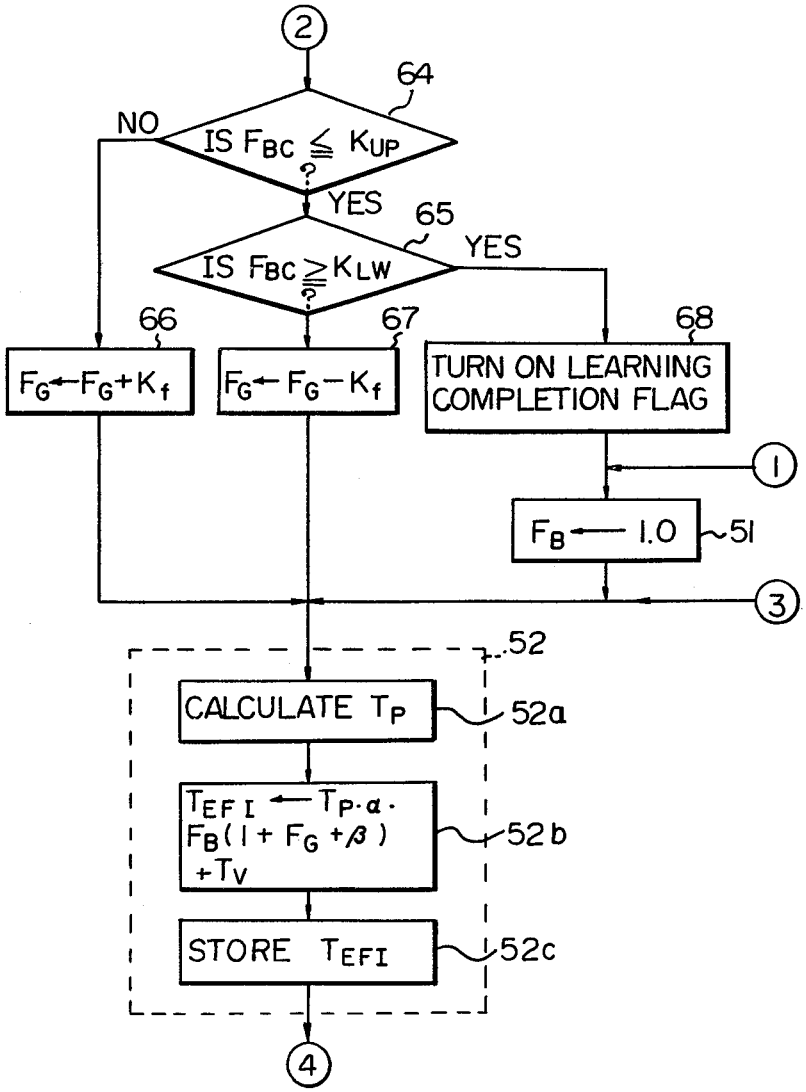

FIG. 4 illustrates a part of one example of the main routine 45 of FIG. 3. Hereinafter, the operation of the learning control and the calculation of the fuel feeding rate is explained in detail, in conjunction with FIG. 4.

At a point 50, the CPU 34 judges whether the engine is fully warmed-up or not by checking the detected coolant temperature THW. During the warming-up operation, since the air-fuel ratio condition is consciously controlled to the rich side relative to the stoichiometric condition, the program proceeds to a point 51 without calculating a learning control correction factor $F_G$. At the point 51, a feedback correction factor $F_B$ is equalized to 1.0. Namely, $F_B \leftarrow 1.0$ is executed at the point 51. Then, the program proceeds to a point 52 where the pulse-width $T_{EFI}$ of the injection signal is calculated, as will be mentioned later. Thereafter, the program proceeds to the point 50 again. After the engine is fully warmed-up, the program proceeds from the point 50 to a point 53 where the CPU 34 judges whether or not a learning operation is completed by checking a learning completion flag. Since the learning completion flag is reset to "off" in the aforementioned initializing routine of FIG. 3, the program proceeds from the point 53 to a point 54 until the learning operation is completed. At the point 54, the CPU 34 checks a learning operation flag. Since this learning operation flag is also reset to "off" in the initializing routine of FIG. 3, the program, at first, proceeds from the point 54 to the steps of points 55 and 56. At the point 55, the feedback correction factor $F_B$ is equalized to a constant $K_S$. Namely, operation of $F_B \leftarrow K_S$ is executed at the point 55. At the next point 56, the learning operation flag is turned on. Thus, in the routines repeated hereafter, the program proceeds from the point to a point 57. The above-mentioned constant $K_S$ is determined to be a certain value, so that the air-fuel ratio condition of the engine is controlled at the stoichiometric condition if the closed loop control operation is carried out by using the constant $K_s$ as the feedback correction factor $F_B$ under a condition where the learning control correction factor $F_G$ is zero and where all the components related to the closed loop control, i.e., sensors and injection valves, operate correctly without producing any error or scatter. As a result, if the step of point 55 is carried out, the air-fuel ratio condition of the engine is rapidly changed from a desired lean air-fuel ratio condition to a condition close to the stoichiometric condition. Hereafter, the learning operation and the closed loop control operation are executed.

At the point 57, the CPU 34 judges whether or not the air-fuel condition of the engine at the present time is on the rich side related to the soichiometric condition, by checking the logic level of the A/F signal applied from the A/F signal forming circuit 38. If it is on the rich side, the program proceeds to a point 58 where the feedback correction factor $F_B$ is decreased by a predetermined valve $K_i$. Namely, operation of $F_B \leftarrow F_B - K_i$ is carried out at the point 58. Then, the program proceeds to a point 60. At the point 57, if it is judged to be on the lean side, the operation of $F_B \leftarrow F_B + K_i$ is carried out at a point 59, and then the program proceeds to the point 60. According to the above-mentioned steps of the points 57 through 59, the feedback correction factor $F_B$ is adjusted.

At the next point 60, the CPU 34 judges whether or not the inversion of the A/F signal has occurred, namely, whether or not there is a difference between the logic level of the A/F signal obtained in the routine of the present cycle and the A/F signal obtained in the routine of the previous cycle. If the inversion has occurred, the program proceeds to a point 61. Contrary to this, if the inversion has not occurred, the program proceeds to the point 52. At the point 61, the CPU34 judges whether or not the inversion is caused by the change from the rich condition to the lean condition. If the inversion is caused by the rich to lean change, the program proceeds to a point 63. If caused by the lean to rich change, the program proceeds to a point 62 where the feedback correction factor $F_B$ at the present time is stored in a predetermined region of the RAM 48 as the maximum value $F_{BMAX}$. Then, the program proceeds to the point 52. At the point 61, if it is jedged that the inversion was caused by the rich to lean change, the mean value $F_{BC}$ of the feedback correction factor $F_B$ is calculated, at the point 63, from the equation $$F_{BC} = \frac{F_{BMAX} + F_B}{2}$$

where $F_{BMAX}$ is the maximum value stored in the RAM 48, and $F_B$ is the feedback correction factor at this time and also is equivalent to the minimum value $F_{BMIN}$ of the feedback correction factor $F_B$.

Figure 5:
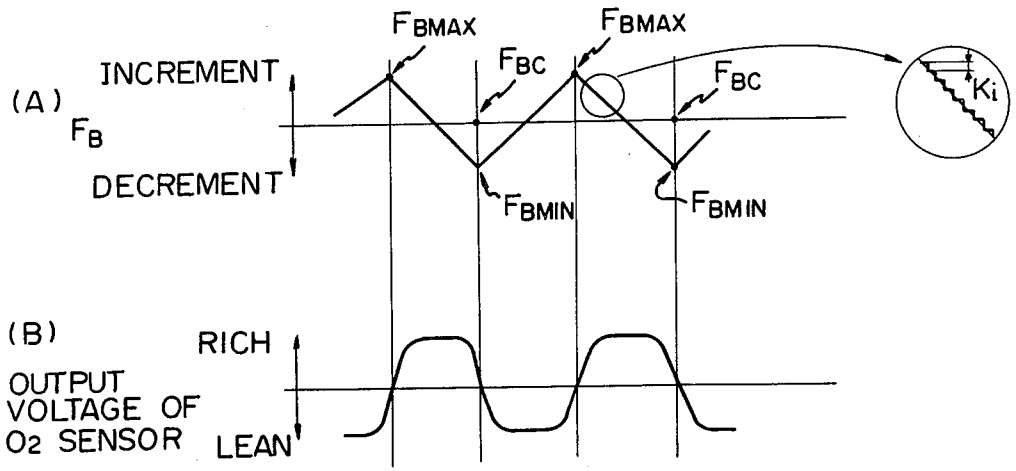
FIGS. 5 and 6 are wave-form diagrams illustrating the operations of the control program shown in FIG. 4.

FIG. 5 illustrates the operation of the above-mentioned steps of the points 57 through 63. In FIG. 5, (A) indicates the feedback correction factor $F_B$, and (B) indicates the output voltage of the $O_2$ sensor 24. The feedback correction factor $F_B$ is stepwise decreased by the value $K_i$ at every routine cycle when the output voltage from the $O_2$ sensor 24 is the level which indicates the rich air-fuel ratio condition. Contrary to this, the factor $F_B$ is stepwise increased by $K_i$ at every routine cycle when the output voltage from the $O_2$ sensor 24 becomes the level indicative of the lean air-fuel ratio condition. At the point 63, the mean value $F_{BC}$ of the maximum value $F_{BMAX}$ and the minimum value $F_{BMIN}$ of the feedback correction factor $F_B$ is calculated, as shown in FIG. 5.

At a next point 64, the CPU 34 judges whether or not the mean value $F_{BC}$ of the feedback correction factor $F_B$ is smaller than or equal to an upper limit value $K_{UP}$. If $F_{BC} \leqq K_{UP}$, the program proceeds to a point 65; on the contrary, the program proceeds to a point 66 if $F_{BC} > K_{UP}$. At the point 66, the learning control correction factor $F_G$, which was reset to zero in the initializing routine of FIG. 3, is increased by a predetermined value $K_f$. Namely, the operation of $F_G \leftarrow F_G + K_f$ is carried out at the point 66. Then the program proceeds to the point 52.

At the point 65, the CPU 34 judges whether or not the mean value $F_{BC}$ of the feedback correction factor $F_B$ is larger than or equal to a lower limit value $K_{LW}$. If $F_{BC} < K_{LW}$, the program proceeds to a point 67 where the learning control correction factor $F_G$ is decreased by the predetermined value $K_f$, and then, proceeds to the point 52. Namely, at the point 67, the operation of $F_G \leftarrow F_G - K_f$ is executed. If $F_{BC} \geqq K_{LW}$, the program proceeds from the point 65 to a point 68, where the learning completion flag is turned on. This is because, if $F_{BC} \geqq K_{LW}$, at the point 65, the mean value $F_{BC}$ is settled within a range between the lower limit value $K_{LW}$ and the upper limit value $K_{UP}$, as $K_{LW} \leqq F_{BC} \leqq K_{UP}$, and, thus, the learning operation is completed. Then the program proceeds to the point 52, through the point 51, where the feedback correction factor $F_B$ is equalized to zero.

The calculation of the fuel feeding rate, namely, the calculation of the pulse-width $T_{EFI}$ of the injection signal at the point 52 is hereinafter explained. At a point 52a, the basic fuel injection pulse-width $T_P$ is calculated. There are two methods for calculating the basic pulse-width $T_P$ is calculated depending upon the rotational speed N of the engine and upon the intake air flow rate Q by using an algebraic function. Namely, the pulse-width $T_P$ is calculated from the input data N and U stored in the RAM 48 as aforementioned by using the function of $$T_P = K \cdot \frac{1000}{U \cdot N}$$

where K is constant. According to the other method, the basic pulse-width $T_P$ is calculated by the interpolation calculation using a data map depending upon the rotational speed N and upon the intake manifold pneumatic pressure P. Namely, the map, indicated by the following table, of basic injection pulse-width $T_P$(msec) relative to the rotational speed N (rpm) and to the intake manifold pneumatic pressure P (mmHg abs) has been stored in the ROM 56 beforehand, and the basic pulse-width $T_P$ is calculated, by using the map, depending upon the input data N and P stored in the RAM 48.

| | P | | | | | | |
|---|---|---|---|---|---|---|---|
| N | 200 | 250 | 300 | 350 | 400 | ... | 750 |
| 800 | 2.0 | 2.3 | 2.6 | 3.0 | 3.5 | ... | 5.0 |
| 1200 | 2.0 | 2.3 | 2.6 | 3.0 | 3.5 | ... | 5.0 |
| 1600 | 2.1 | 2.4 | 2.7 | 3.1 | 3.6 | ... | 5.1 |
| 2000 | 2.1 | 2.4 | 2.7 | 3.1 | 3.6 | ... | 5.1 |
| 2400 | 2.1 | 2.4 | 2.7 | 3.1 | 3.6 | ... | 5.1 |
| 2800 | 2.2 | 2.5 | 2.8 | 3.2 | 3.7 | ... | 5.2 |
| 3200 | 2.2 | 2.5 | 2.8 | 3.2 | 3.7 | ... | 5.2 |
| . | . | . | . | . | . | . | . |
| . | . | . | . | . | . | . | . |
| . | . | . | . | . | . | . | . |
| 6500 | 2.5 | 2.8 | 3.1 | 3.5 | 4.0 | ... | 5.5 |

P: mmHg abs.
N: rpm

At a point 52b, the CPU 34 calculates a final fuel injection pulse-width $T_{EFI}$ based upon the basic pulse-width $T_P$, the feedback correction factor $F_B$, the coolant temperature correction factor $\alpha$(THW), the learning control correction factor $F_G$, another correction factor $\beta$ and the ineffective injection time $T_V$ of the injection valve, according to the following algebraic function, $$T_{EFI}=T_P\cdot\alpha(THW)\cdot F_B\cdot(1.0+F_B+\beta)+T_V$$

the coolant temperature correction factor $\alpha$(THW) is obtained depending upon the coolant temperature THW to increase the fuel feeding rate during the warming-up condition of the engine. The other correction factor $\beta$ includes the fuel increment coefficient just after starting and an acceleration fuel increment coefficient. The calculated injection pulse-width $T_{EFI}$ is stored in a predetermined region of the RAM 48 at a point 52c. The injection pulse-width $T_{EFI}$ is read out by the interrupt routine for the fuel injection operation shown in FIG. 3, and converted into an injection signal having a pulse-width $T_{EFI}$. The converted injection signal is sent to the output port 40, so as to energize the fuel injection valve 26.

Figure 6:
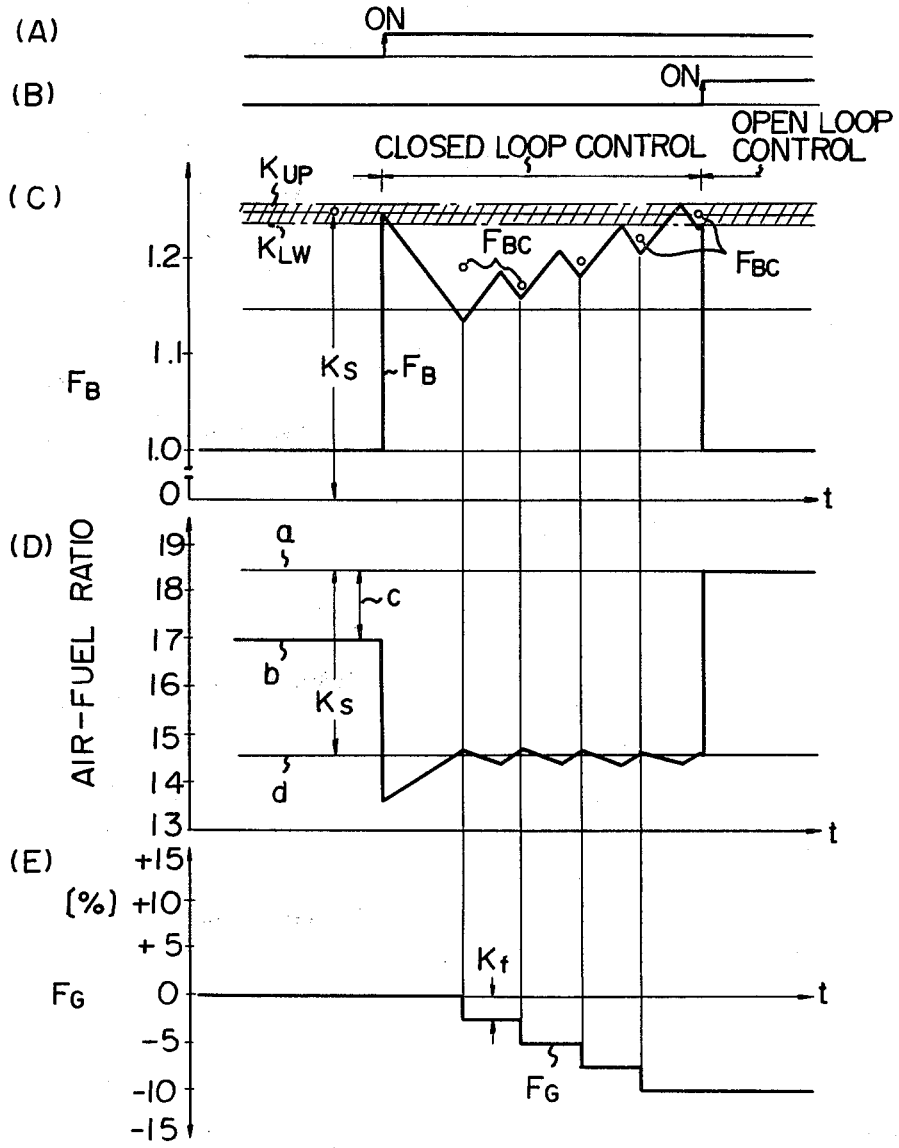

FIG. 6 illustrates the operation of the processing routine shown in FIG. 4. In FIG. 6, (A) indicates the learning operation flag, (B) the learing completion flag, (C) the feedback correction factor $F_B$, (D) the air-fuel ratio of gas in the engine, and (E) the learning control correction factor $F_G$.

As mentioned hereinbefore, the air-fuel ratio control system according to the present invention controls the air-fuel ratio condition at a desired condition on the lean side relative to the stoichiometric condition. For explanation, suppose that the desired air-fuel ratio of the air-fuel ratio control operation is 18.5 and the actual air-fuel ratio obtained by the air-fuel ratio control operation is 17.0. In FIG. 6(D), a indicates the above desired air-fuel ratio, b indicates the above actual air-fuel ratio, and c indicates the difference between the desired and actual air-fuel ratios. The difference c, which is caused by the amount of scatter in the measured or controlled value by the components in the air-fuel ratio control system, indicates the deviation of the air-fuel ratio control. As shown in FIG. 6(C), the feedback correction factor $F_B$ is generally maintained at 1.0 ($F_B=1.0$). However, when the learning operation is executed, that is, when the feedback control operation is executed, the feedback correction factor $F_B$ is changed to $K_S$($F_B \leftarrow K_S$) at the initiation of the operation. In the case where there is no control deviation, the actual air-fuel ratio b will be converged to a value close to the stoichiometric air-fuel ratio d by equalizing the feedback correction factor $F_B$ to $K_S$. However, if the control deviation c exists, the actual air-fuel ratio b greatly deviates from the stoichiometric air-fuel ratio d at the initiation of the learning operation (feedback control operation). According to the present invention, the actual air-fuel ratio b is converged to a value close to the stoichiometric air-fuel ratio d by changing the feedback correction factor $F_B$ depending upon the signal from the $O_2$ sensor 24, namely, by executing the feedback control operation based on the signal from the $O_2$ sensor 24. Furthermore, according to the present invention, the feedback correction factor $F_B$ itself is controlled, so that the mean value $F_{BC}$ of the factor $F_B$ is settled within a range, as $K_{LW} \leqq F_{BC} \leqq K_{UP}$. This latter control of the feedback correction factor $F_B$ is executed by changing the learning control correction factor $F_G$.

As will be apparent from the above explanation, according to the present invention, the learning operation is performed by adjusting the learning control correction factor $F_C$, so as to settle the mean value $F_{BC}$ of the feedback correction factor $F_B$ within a certain range (shaded portion in FIG. 6(C), as well as by adjusting the feedback correction factor $F_B$, so as to converge the actual air-fuel ratio to a value close to the stoichiometric air-fuel ratio. When the $F_{BC}$ is settled within the shaded range of FIG. 6(C), the learning operation is completed. Thereafter, the closed loop control of the air-fuel ratio is stopped by fixing the feedback correction factor $F_B$ to 1.0 ($F_B=1.0$), and the air-fuel ratio condition is controlled by the open loop control operation by using the learning control correction factor $F_G$. As a result, the actual air-fuel ratio b is maintained at the desired air-fuel ratio a, as shown in FIG. 6(D).

According to the processing routine of FIG. 4, as mentioned in detail, the actual air-fuel ratio condition can be correctly controlled to the desired lean air-fuel ratio condition even if the components used in the air-fuel ratio control system have errors or scatters in their measured and/or controlled values. Furthermore, according to the processing routine of FIG. 4, since the feedback correction factor $F_B$ is instantaneously changed to $K_S$ at the initiation of the learning operation and, also, is instantaneously returned to 1.0 at the completion of the learning operation, the period of time necessary for the learning operation can be shortened. During the learning operation, the actual air-fuel ratio is controlled to a different value from the desired lean air-fuel ratio by the closed loop control (feedback control). Therefore, it is preferable to shorten the learning operation period as much as possible.

Figures 7, 7A, 7B:
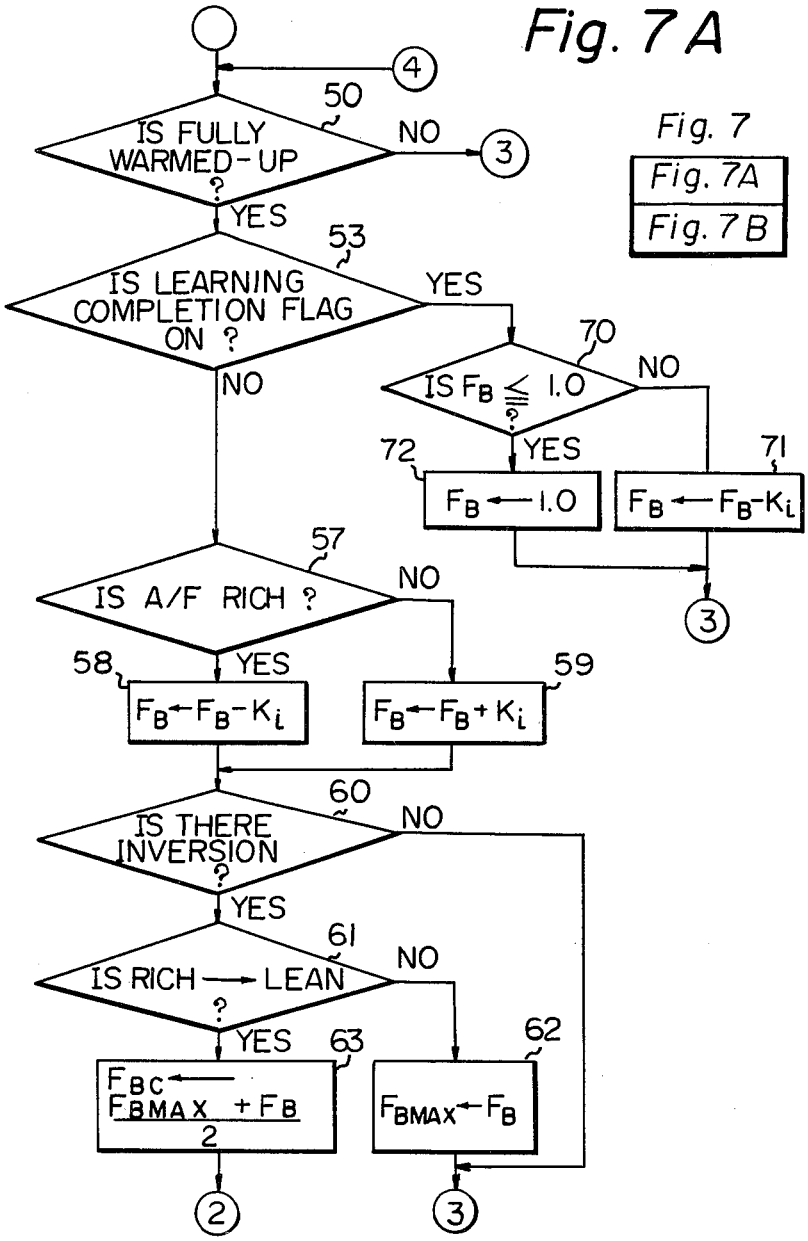
FIG. 7 is a flow diagram illustrating a part of another example of the control program shown in FIG. 3.
Figure 7B:
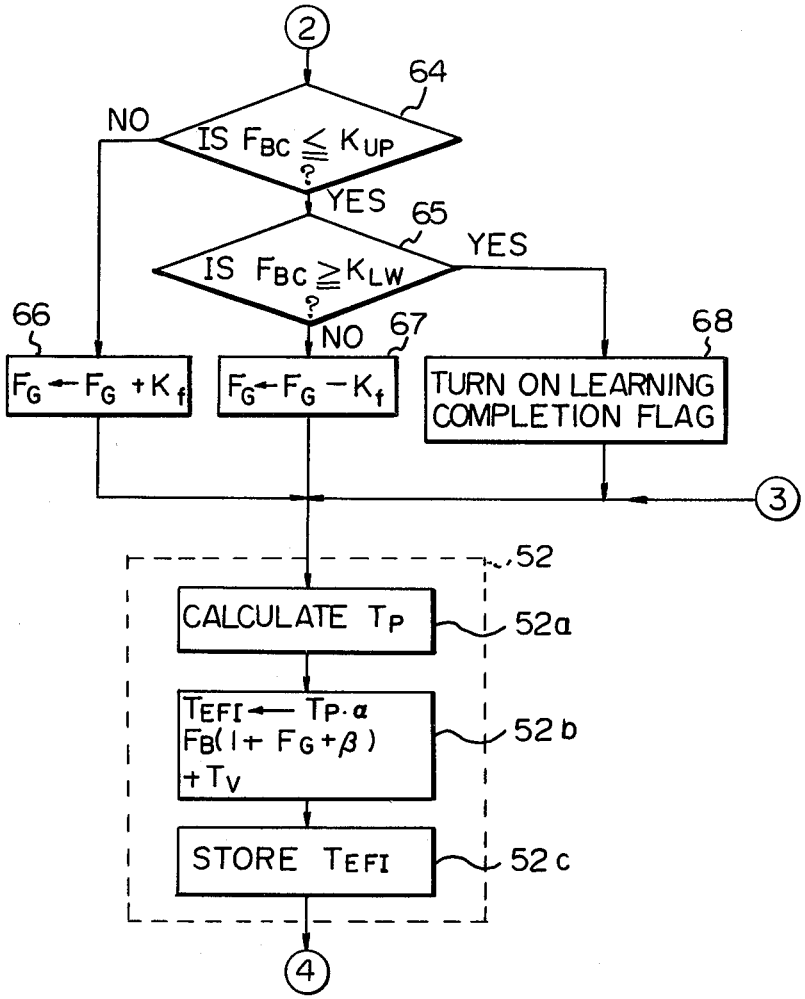

FIG. 7 illustrates a part of another example of the main routine 45 of FIG. 3. The difference between the examples of FIGS. 4 and 7 lies in the control method of the feedback correction factor $F_B$ at the initiation and the completion of the learning operation. Hereinafter, only the operation of the processing routine of FIG. 7 different from that of FIG. 4 is explained.

In the processing routine of FIG. 7, if it is judged that the engine is now warming-up at the point 50, the program directly jumps to the point 52 where the fuel feeding rate is calculated. At the point 53 of FIG. 7, if it is judged that the learning completion flag is on, the program proceeds to a point 70 where the CPU 34 judges whether or not the feedback correction factor $F_B$ is smaller than or equal to 1.0. If $F_B > 1.0$, the program proceeds to a point 71 where the operation of $F_B \leftarrow F_B - K_i$ is executed. If $F_B \leqq 1.0$, the program proceeds to a point 72 where the factor $F_B$ is forcibly equalized to 1.0. Thereafter, the program proceeds to the point 52. At the point 53 of FIG. 7, if it is judged that the learning operation is not completed, the program proceeds to the point 57 without equalizing the feedback correction factor $F_B$ to $K_S$, and the closed loop control operation is executed. According to the processing routine of FIG. 7, furthermore, after turning on the learning completion flag at the point 68, the CPU 34 executes the calculation of the fuel feeding rate at the point 52, without equalizing the feedback correction factor $F_B$ to 1.0.

Figure 8:
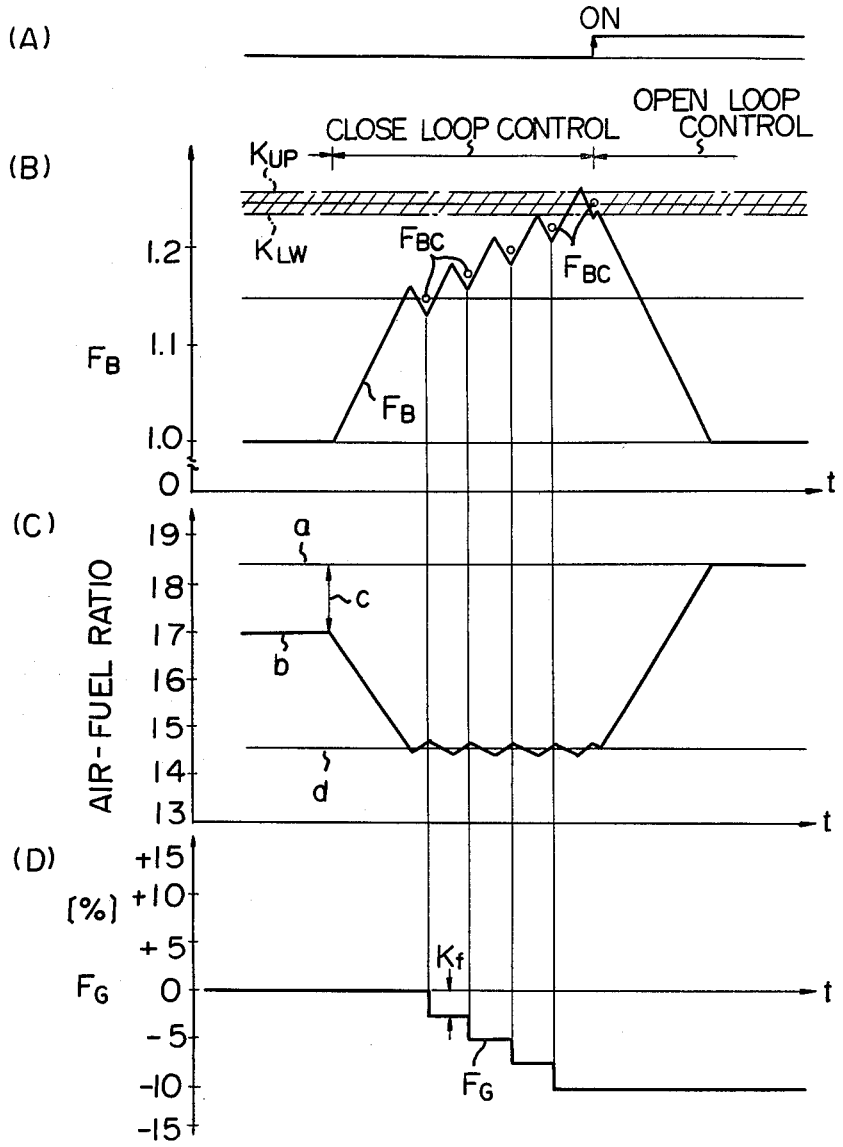
FIG. 8 is a wave-form diagram illustrating the operations of the control program shown in FIG. 7.

FIG. 8 illustrates the operation of the processing routine shown in FIG. 7. In FIG. 8, (A) indicates the learning completion flag, (B) the feedback correction factor $F_B$, (C) the air-fuel ratio of gas in the engine, and (D) the learning control correction factor $F_G$. According to the processing routine of FIG. 4, since the feedback correction factor $F_B$ is changed from 1.0 to $K_S$ at the initiation of the learning operation and changed to 1.0 at the completion of the learning operation in order to shorten the learning period of time, the air-fuel ratio condition is correspondingly and instanteneously changed from the lean condition to the stoichiometric condition, and vice versa. As a result, engine torque rapidly changes at the initiation and completion of the learning operation, causing the operation characteristics of the engine to detriorate. According to the processing routine of FIG. 7, therefore, when the learning operation is initiated or completed, the feedback correction factor $F_B$ is gradually changed, as shown in FIG. 8(B), depending upon a predetermined time constant which is determined relying upon the constant $K_i$. As a result, the air-fuel condition gradually changes as shown in FIG. 8(C), causing the operation characteristics of the engine to improve. Other operations and effects of the processing routine of FIG. 7 are the same as those of FIG. 4.

As will be apparent from the foregoing description, the present invention can correctly control, by an open loop, the air-fuel ratio condition at a desired lean air-fuel ratio condition even when there are scatters or errors measured by the sensors and/or scatters or errors controlled by control elements, which sensors and elements are used for control the air-fuel ratio condition. Therefore, the characteristics of the emitted amount of HC, CO, and $NO_x$ from the lean burn engine, fuel consumption of the lean burn engine, and output torque of the lean burn engine can be improved.

As many widely different embodiments of the present invention may be constructed without departing from the spirit and scope of the present invention. It should be understood that the present invention is not limited to the specific embodiments described in this specification, except as defined in the appended claims.

We claim:

1. A method for controlling an air-fuel ratio of an internal combustion engine having a sensor means for detecting whether the air-fuel ratio is rich or lean with respect to a stoichiometric condition and producing an air-fuel ratio signal indicative thereof, said method comprising the steps of:

detecting an operating condition of the engine and producing an engine parameter signal indicative thereof;

controlling, in response to the engine parameter signal and the air-fuel ratio signal, by a closed loop control operation, the fuel feeding rate to the engine only when the engine is operated under a first predetermined operating condition, said closed loop control step including the steps of: calculating a feedback correction factor related to the fuel feeding rate depending upon the air-fuel ratio signal; correcting the fuel feeding rate to the engine in accordance with the calculatd feedback correction factor, so as to control the air-fuel ratio condition of the engine substantially close to the stoichiometric condition and adjusting a learning control correction factor so as to settle said feedback correction factor within a predetermined range while at the same time maintaining the air-fuel ratio condition of the engine close to the stoichoimetric condition the adjusting of the learning control correction factor including the steps of calculating the mean value of the feedback correction factor; and adjusting a learning control correction factor so as to settle the mean value within a predetermined range while at the same time maintaining the air-fuel ratio condition of the engine close to the stoichiometric condition; and controlling, in response to the engine parameter signals and the adjusted learning control operation factor, by an open loop control operation, the fuel feeding rate of the engine, so as to maintain the air-fuel ratio condition of the engine at a desired condition which is different from the stoichiometric condition, after the closed loop control operation is completed.

2. A method as claimed in claim 1, wherein said mean value is calculated from the maximum and minimum values of the feedback correction factor.

3. A method as claimed in claim 1, wherein the feedback correction factor is at first equalized to a value which lies within the said predetermined range when the closed loop control operation is initiated.

4. A method as claimed in claim 1, 2 or 3, wherein said closed loop control operation is executed until the feedback correction factor is settled within a predetermined range.

5. A method as claimed in claim 4, wherein said open loop control operation includes a step of controlling, in response to the engine parameter signals and the adjusted learning control correction factor, the fuel feeding rate of the engine, so as to gradually change the air-fuel ratio condition of the engine from a condition close to the stoichiometric condition to a desired condition different from the stoichiometric condition, just after the closed loop operation is completed.

6. A method as claimed in claim 1, wherein said predetermined operating condition is a fully warmed-up condition of the engine.

7. A method as claimed in claim 1, wherein said closed loop control operation is executed at least one time each time after the engine is started and is fully warmed-up.

* * * * *